US012604951B2

(12) United States Patent
Kitchen

(10) Patent No.: US 12,604,951 B2
(45) Date of Patent: Apr. 21, 2026

(54) ERGONOMIC QUICK ACCESS WALLET

(71) Applicant: Michael Kitchen, Aston, PA (US)

(72) Inventor: Michael Kitchen, Aston, PA (US)

( * ) Notice: Subject to any disclaimer, the term of this patent is extended or adjusted under 35 U.S.C. 154(b) by 0 days.

(21) Appl. No.: 18/736,907

(22) Filed: Jun. 7, 2024

(65) Prior Publication Data

US 2025/0375007 A1 Dec. 11, 2025

(51) Int. Cl.
*A45C 1/06* (2006.01)
*A45C 13/00* (2006.01)

(52) U.S. Cl.
CPC ..... *A45C 1/06* (2013.01); *A45C 13/005* (2013.01); *A45C 2001/067* (2013.01)

(58) Field of Classification Search
CPC ..... A45C 11/182; A45C 2011/186
USPC ..... 150/147
See application file for complete search history.

(56) References Cited

U.S. PATENT DOCUMENTS 1,040,051 A 10/1912 Swihart
3,648,832 A 3/1972 Kirshenbaum et al.
4,202,445 A * 5/1980 Porter ..... A45C 11/182 206/37
4,647,714 A 3/1987 Goto
5,080,223 A 1/1992 Mitsuyama
5,125,505 A 6/1992 Kurosaki
5,423,363 A 6/1995 Matzdorff et al.
5,546,278 A 8/1996 Bethurum
5,560,476 A 10/1996 Lee
5,718,329 A 2/1998 Ippolito et al.
5,725,098 A 3/1998 Seifert et al.
5,791,461 A 8/1998 Tsuge
5,865,307 A * 2/1999 Friedman ..... A45C 13/1092 206/37.1
5,941,375 A 8/1999 Kamens et al.
6,082,422 A 7/2000 Kaminski
6,089,289 A 7/2000 Florjancic
6,121,544 A 9/2000 Petsinger
D433,565 S 11/2000 Kojoori
D434,899 S 12/2000 Kojoori
6,155,410 A 12/2000 Davis
D436,252 S 1/2001 Gribovsky
6,483,719 B1 11/2002 Bachman
D470,657 S 2/2003 Kawamura
6,601,622 B1 8/2003 Young
6,892,880 B2 5/2005 Nieves
7,163,152 B2 1/2007 Osborn et al.
7,246,556 B1 7/2007 Stoneberg et al.
D550,453 S 9/2007 Ford
7,482,925 B2 1/2009 Hammad et al.
7,523,870 B2 4/2009 Lowe
7,830,672 B1 11/2010 Kitchen
7,918,335 B1 4/2011 Kitchen
7,921,890 B2 4/2011 Ho
8,237,063 B2 8/2012 Chang
D666,811 S 9/2012 Yang
8,267,247 B1 9/2012 Horiyama
(Continued)

*Primary Examiner* — Nathan J Jenness
*Assistant Examiner* — Jessica Kavini Tamil
(74) *Attorney, Agent, or Firm* — PAUL & PAUL

(57) ABSTRACT

An ergonomic, quick access wallet includes a pair of housings joined by a hinge and rotatable from a closed position to an open position. Each housing has a chamber for receiving cards through a slot provided at one end. The wallet can be opened to access a tray on the interior of each housing for storing cards, currency, coins and the like.

19 Claims, 12 Drawing Sheets

(56) References Cited

U.S. PATENT DOCUMENTS

| | | | | |
|---|---|---|---|---|
| 8,567,459 | B2 * | 10/2013 | Kitchen | A45C 11/182 150/147 |
| 8,662,293 | B2 | 3/2014 | Lazott et al. | |
| D705,538 | S | 5/2014 | Dietrich | |
| 8,899,411 | B2 | 12/2014 | Van Geer | |
| 8,921,693 | B2 | 12/2014 | Benedetto et al. | |
| 8,985,387 | B2 | 3/2015 | Kobayashi | |
| 8,989,826 | B1 | 3/2015 | Connolly | |
| D728,223 | S | 5/2015 | Setre Shens | |
| 9,814,289 | B2 | 11/2017 | Lay et al. | |
| 9,877,556 | B1 | 1/2018 | Holder | |
| D810,429 | S | 2/2018 | Kitchen | |
| D810,430 | S | 2/2018 | Kitchen | |
| 9,907,375 | B1 | 3/2018 | Kitchen | |
| D821,099 | S | 6/2018 | Kitchen | |
| D883,664 | S | 5/2020 | Chen et al. | |
| 11,311,087 | B2 | 4/2022 | Del Moral et al. | |
| 11,439,214 | B2 * | 9/2022 | Tran | B25F 5/029 |
| 2005/0150961 | A1 | 7/2005 | Porter | |
| 2007/0194128 | A1 | 8/2007 | Coe et al. | |
| 2007/0284264 | A1 | 12/2007 | Davis | |
| 2008/0149525 | A1 | 6/2008 | Horiuchi et al. | |
| 2008/0190526 | A1 | 8/2008 | O'Shea | |
| 2009/0260731 | A1 | 10/2009 | Roth et al. | |
| 2013/0025750 | A1 * | 1/2013 | Wingerter | A45C 1/02 150/149 |
| 2014/0014576 | A1 | 1/2014 | Jeong et al. | |
| 2014/0203020 | A1 | 7/2014 | Trombino | |
| 2016/0014922 | A1 | 1/2016 | Banerjee et al. | |

* cited by examiner

ERGONOMIC QUICK ACCESS WALLET

BACKGROUND

Field of the Invention

This invention relates to card cases and wallets, and more specifically to wallet-sized electromagnetic shielding or RFID blocking card cases for holding and protecting personal articles such as credit cards, debit cards, chip and pin cards, contactless smartcards, licenses, identification cards, paper currency, receipts, tickets, and the like.

Prior Art

Conventional bi-fold and tri-fold wallets are primarily designed to hold paper currency, a plurality of cards including credit and bank cards, and other important cards such as a driver's license or IDs, which are not easily replaced if lost. These traditional wallets are typically shaped and sized to be able to fit inside one's pocket for easy transport, and are typically made from a soft leather or fabric material with card pockets on the insides. While convenient for carrying cards and paper currency, these wallets have a number of functional, security, and durability issues including:

a) card pockets are very difficult to get cards out of, and usually force a user to first open the wallet and then dig underneath the edge of a card with their finger in order to get a grip on it and pull it out, making it slow and inconvenient to access a card;
b) card pockets rely on the material of the wallet itself to adequately grip and secure a card, and can make it harder to remove a card if that slot is tight;
c) card pockets pose the risk of cards accidentally sliding out as the card pocket stretches and loosens over time with use;
d) lack of crush resistance if carried in one's back pocket or a bag with other items, which could cause cards inside the wallet to bend or crack over time, affecting their usability;
e) lack of shielding against unauthorized RFID (Radio Frequency Identification) scanning of contactless or RFID enabled credit, bank, or work entry cards, also known in the industry as "skimming" or RFID theft;
f) leather or fabric wallets that do have RFID shielding typically have thin, flimsy shielding liners in the form of aluminum foil embedded in their layers, which can crumple, tear or crack with repeated folding and use, which could cause a gap in the RFID shielding effect;
g) lack of ergonomics, often requiring two handed operation for finding, accessing, and removing a card from inside the wallet.

A growing trend in the wallet industry is to make "minimalist wallets." These wallets are as slim and compact as possible and store a minimal amount of cards inside while also typically having a traditional steel or plastic money clip on their exterior. Some of these minimalist wallets are made from more traditional materials such as leather or fabric. Others use a stronger material for its main card housing like aluminum or plastic. Moreover, some of these more rigid card holders force the user to eject cards out from a housing with a complex ejector mechanism or assembly. All of these types of wallets also have security, durability and functional issues including:

a) the money clips typically found on the exterior of these wallets force a user to keep paper currency on the outside of the wallet, which raises a privacy risk when you do not want others to see how much cash you are carrying;
b) the money clips are typically made from steel and have hard, sharp edges, as well as an upstanding lip at its distal edge which can be uncomfortable or painful against one's thigh while in a pocket and can even wear a hole in one's pocket over time;
c) paper currency stored under an exterior money clip has the risk of accidentally sliding or falling off the wallet as it is slid in and out of one's pocket with use;
d) the ejector mechanisms in wallets with more rigid housing materials have been known in the industry to jam or break all together, resulting in cards being stuck inside the wallet with no way to remove them. They also force a user to activate an awkwardly positioned lever or switch in order to eject cards out, adding an unnecessarily complicated step just to get a card out of your wallet.

Hence, there exists a need for a secure, compact and crush resistant wallet which holds and protects a plurality of cards from being crushed or bent, yet allows a user to access multiple cards quickly and intuitively without hassle and without awkward ejector mechanisms. The proposed wallet must also shield cards stored inside from RFID scanning, and keep paper currency, receipts, tickets and the like discreetly and securely stored inside of it, away from public view.

SUMMARY OF THE INVENTION

The present invention is directed toward an improved ergonomic quick access wallet that is carried in one's pocket, bag, or purse. A currently preferred embodiment of the wallet comprises a first housing and a second housing joined by a hinge, with each housing being rotatable about the hinge between a closed position and an open position. Each housing comprises a housing base and a housing cover which are attached to one another. Each housing cover has a generally rectangular planar shape with a pair of side walls upstanding from its two longitudinal sides. Each housing base has a generally rectangular shape with a front portion, a rear portion, and a bottom portion that has an interior surface and an exterior surface. The housing covers substantially cover the interior surface of the bottom portion of each housing base. The side walls of each housing cover extend between the front and rear portions of the housing base to form a card chamber for each housing. The interior surfaces of the bottom portions of each housing base serve as the bottom surface of each card chamber. Each housing cover has a finger aperture which allows a user to eject cards out quickly and easily from the card chambers.

The front and rear portions of each housing base and the side walls of each housing cover extend past and substantially perpendicular to the exterior surface of the bottom portion of each housing base to form a tray for holding contents, with the exterior surface of the bottom portion of each housing base providing the main surface for each respective tray. When the wallet is in a closed position, contents stored in the trays are retained and cannot fall out of the wallet. A releasable lock keeps the first housing secured against the second housing. The longitudinal edges of the first and second housing covers comprise a rounded exterior edge to keep the wallet edges soft, comfortable, and ergonomic to hold and rotate in one's hand. Each housing is made from a substantially rigid RFID protective material such as aluminum, steel, titanium, or carbon fiber reinforced material, so that when the wallet is in the closed position all cards stored inside are shielded from unauthorized RFID scanning.

It is a primary objective of this invention to provide an ergonomic quick access wallet that holds a plurality of cards that can be accessed quickly and without complication, and also allows a user to comfortably rotate the wallet in one's hand to alternate between accessing cards stored in the first card chamber or the second card chamber.

It is another objective of this invention to make the wallet crush resistant to protect cards stored inside from being crushed, cracked, or bent with use.

It is another objective of this invention to make the housing covers out of a substantially rigid material with inherent RFID shielding properties, such as aluminum, titanium, steel, or carbon fiber so that all cards stored inside the wallet are shielded from unauthorized RFID scanning.

It is another objective of this invention to use a resilient means inside each card chamber to securely grip the side of a stack of cards and prevent them from falling out, but be malleable enough to allow a user to push cards out with the force of their finger.

It is another objective of this invention to store important items such as a driver's license or ID card, as well as paper currency, receipts, tickets, and the like inside the trays of the wallet to keep them private and safe from falling out.

It is another objective of this invention to provide a releasable locking means to keep the first and second housings closed against each other to consistently maintain the RFID shielding effect of all cards stored inside and also prevent contents stored in the first or second trays from falling out.

It is another objective of this invention to allow the releasable locking means to automatically lock itself shut when the wallet is closed.

It is another objective of this invention to provide finger apertures on each housing cover to allow a user to eject and shuffle cards out from each card chamber, mimicking the same intuitive gesture millions of people already use when scrolling up or down with their thumbs while on their mobile phones.

It is another objective of this invention to allow easy assembly of the wallet without the use of fasteners, adhesives, or screws, which greatly reduces manufacturing and assembly costs and eliminates issues such as screws becoming loose over time and falling out.

These objectives are realized in a presently preferred embodiment of the invention, while other embodiments may only realize some of these objectives.

DETAILED DESCRIPTION

Figure 1:
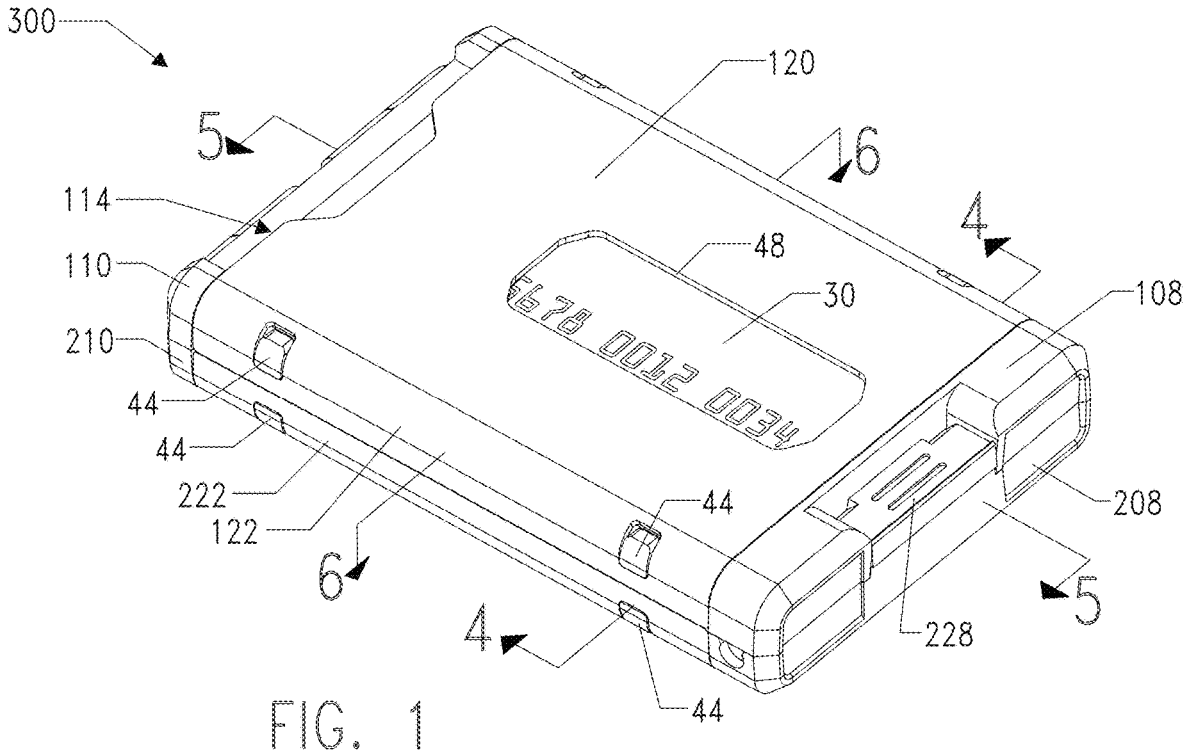
FIG. 1 is a perspective isometric view of the front side of an embodiment of the wallet of the present invention shown in a closed position.
Figure 1A:
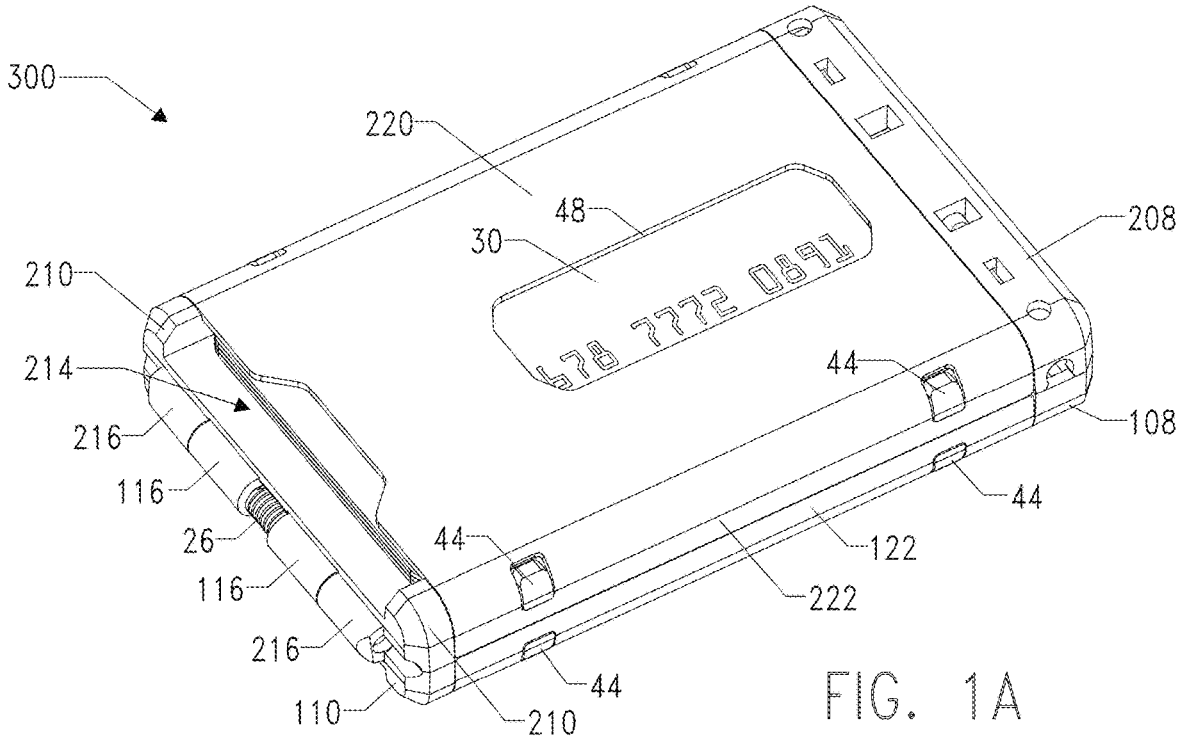
FIG. 1A is a perspective isometric view of the rear side of the wallet of FIG. 1 shown in the closed position.
Figure 2:
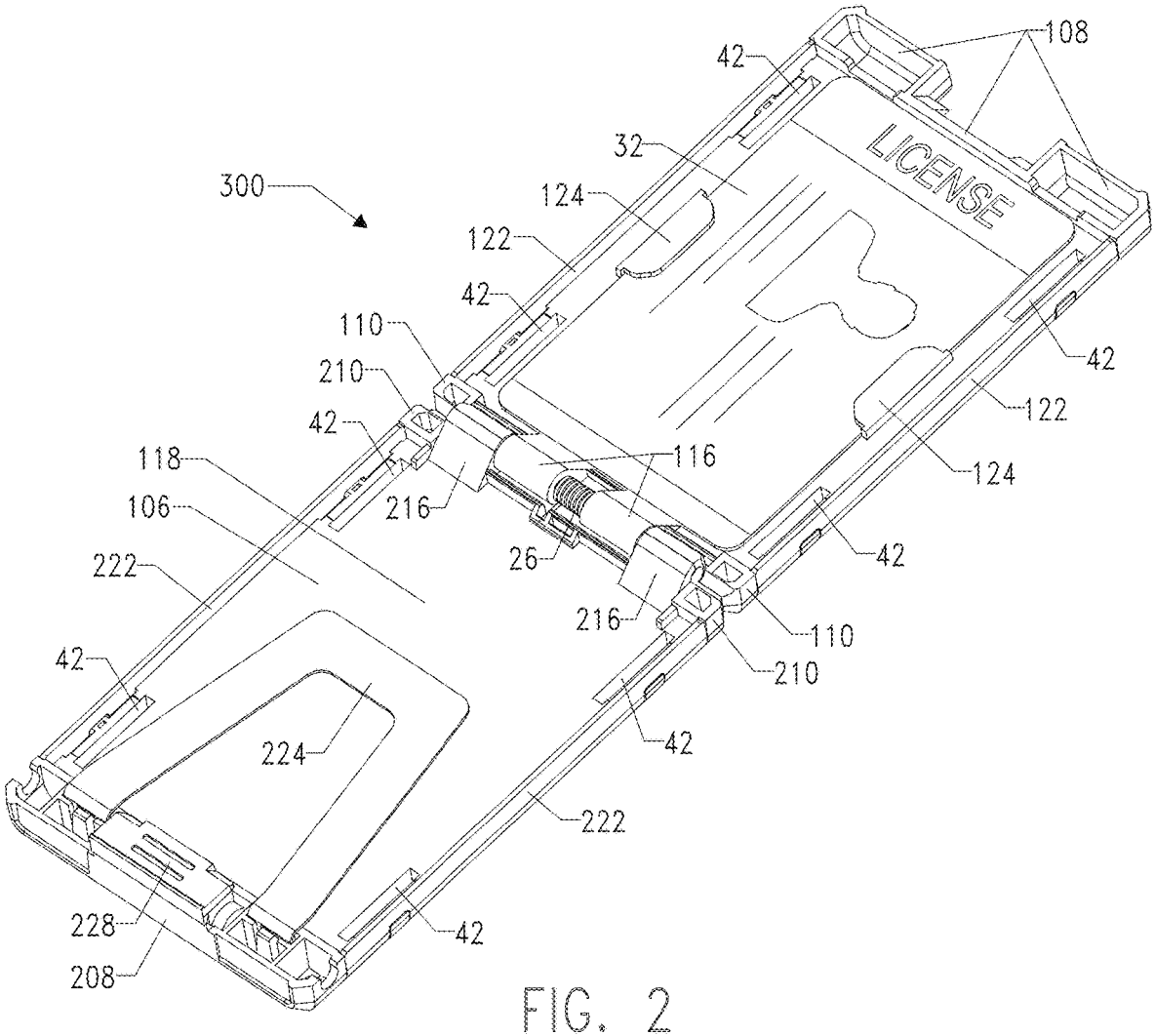
FIG. 2 is a perspective isometric view of the wallet of FIG. 1 shown in a fully open position as seen from above.
Figure 9:
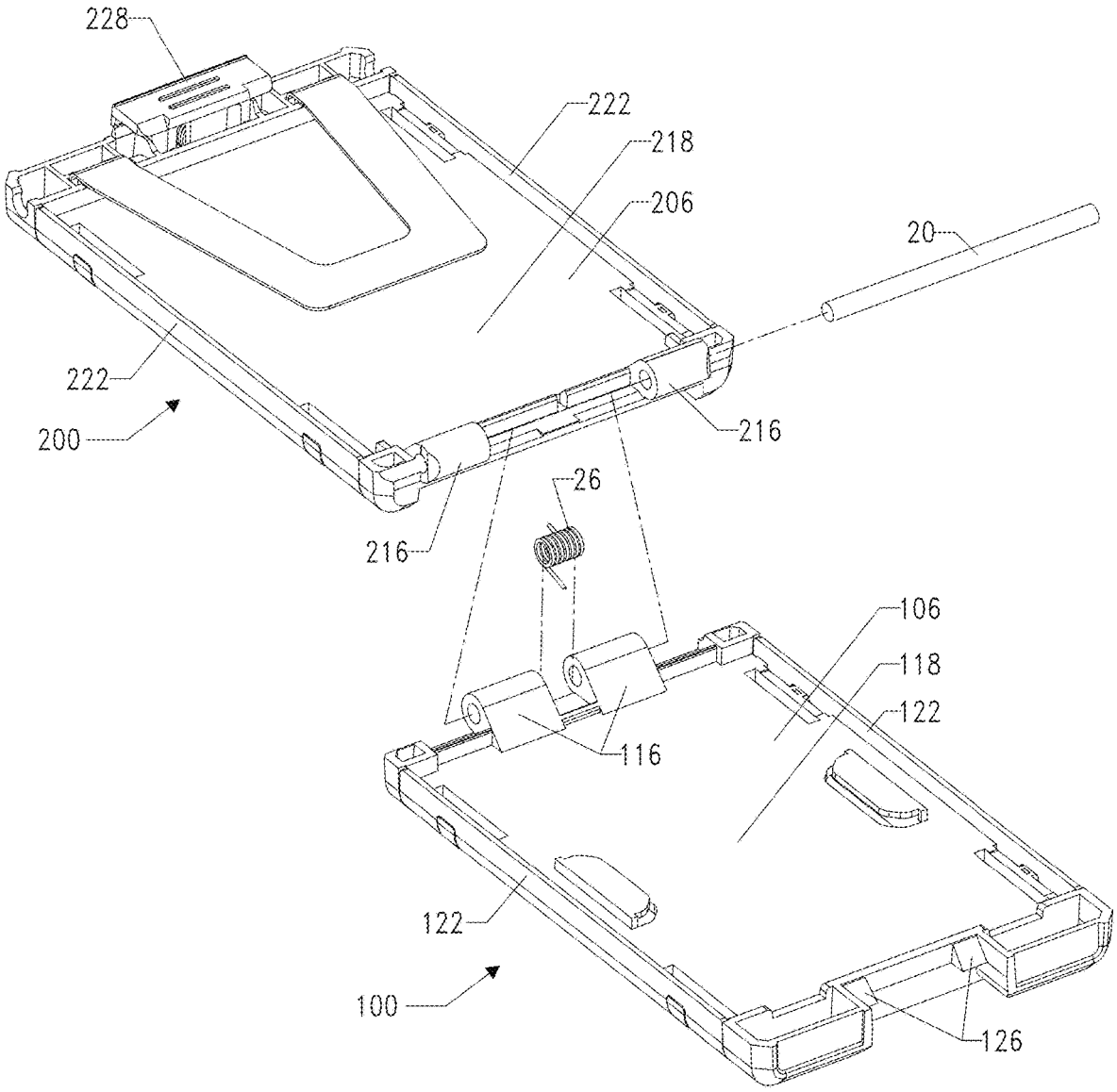
FIG. 9 is an exploded perspective view of the wallet of FIG. 1 showing how the first housing and second housing are connected together with a hinge pin, as well as how the torsion spring is positioned.

An ergonomic quick access wallet 300 which is a presently preferred embodiment of the present invention is shown in a closed position in FIGS. 1, 1A, 3, 3A, 4, and 5, and in a fully open position in FIG. 2. FIG. 9 shows a partially exploded view of wallet 300 separated into its two main assemblies-first housing 100 and second housing 200.

First Housing

Figure 7:
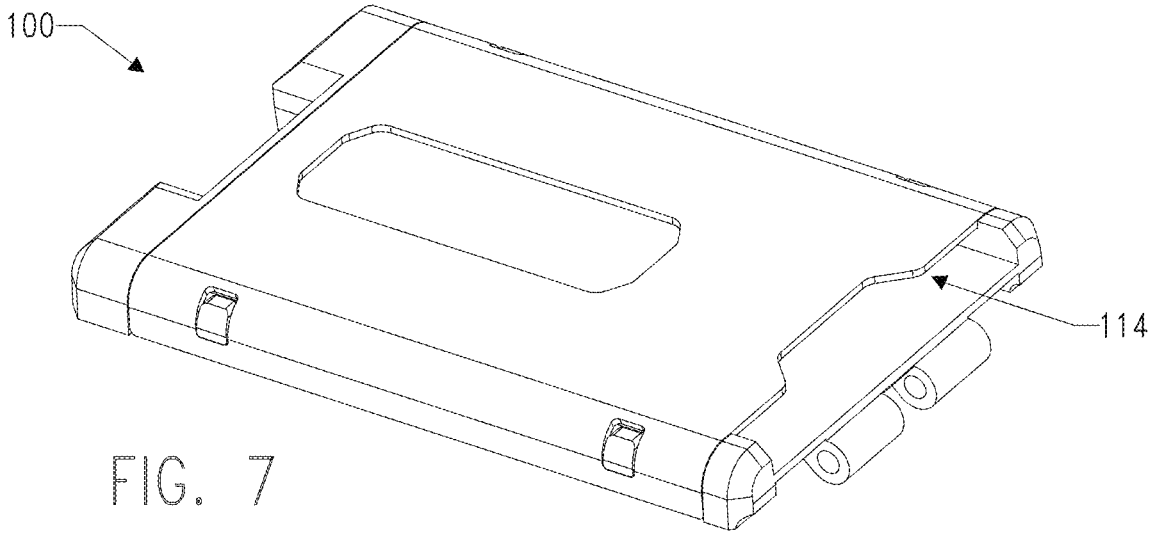
FIG. 7 is a perspective view of the first housing of the wallet of FIG. 1.

A first housing 100, as seen in FIG. 7 and as part of FIG. 9, comprises a first housing base 102 attached to a first housing cover 120.

The first housing base 102 (seen in FIG. 7A) has a generally rectangular planar shape and comprises two longitudinal sides and two transverse ends and has a bottom portion with an interior surface 104 (seen in FIG. 7A) and an exterior surface 106 (seen in FIG. 9). The first housing base 102 further comprises a front portion 108 and a rear portion 110. The front portion 108 and the rear portion 110 both extend vertically inwardly past interior surface 104 and outwardly past the exterior surface 106.

The bottom portion of the first housing base 102 separates a first card chamber 112 from a first tray 118, with the interior surface 104 of the bottom portion of the base 102 forming a portion of the first card chamber 112 while the exterior surface 106 of the bottom portion of the base 102 forms a portion of the first tray 118.

Figure 7A:
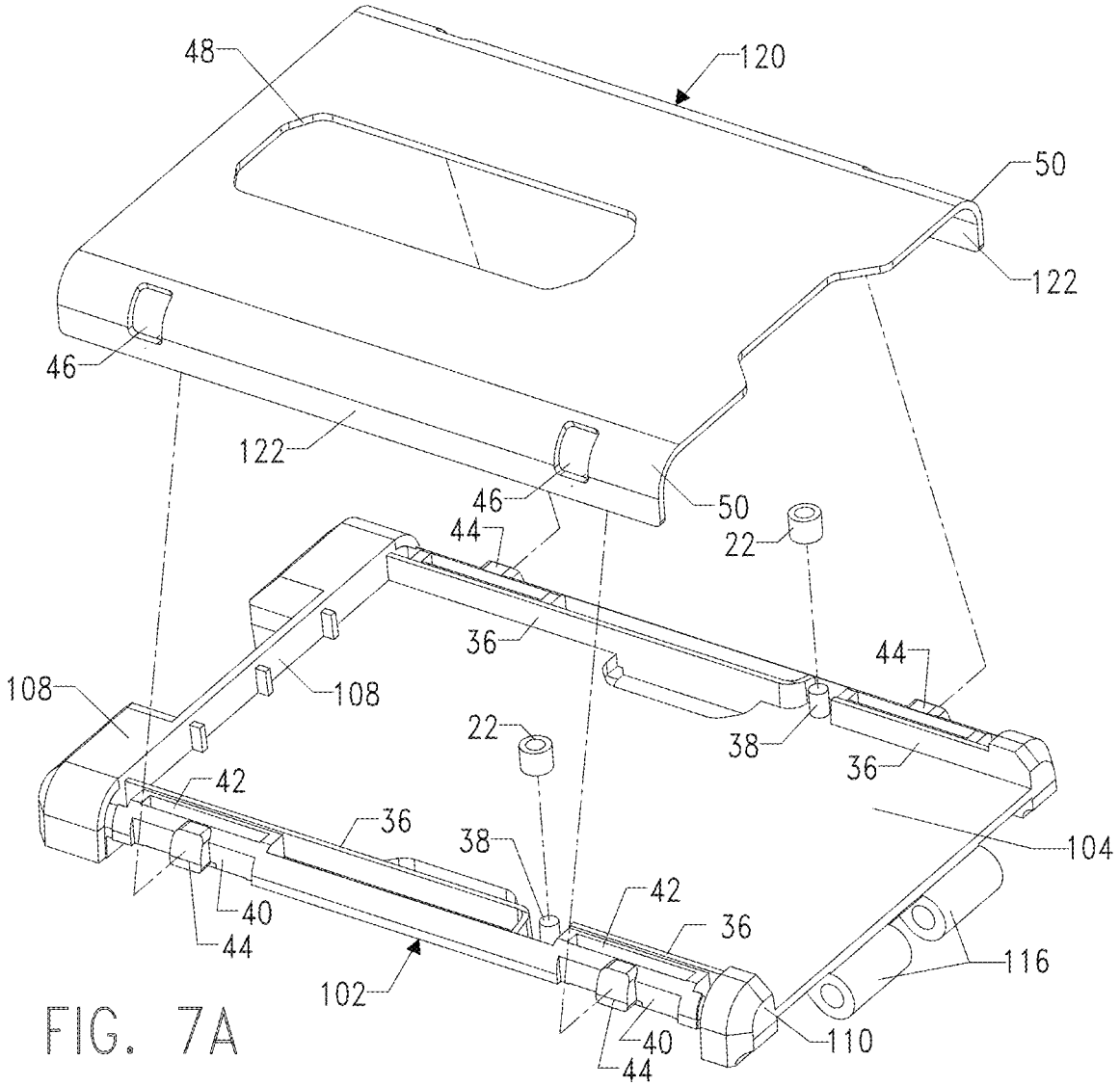
FIG. 7A is an exploded perspective view of the first housing of FIG. 7 showing how the rubber tubes and first housing cover are attached and fastened to the first housing base.

Proximate to and spaced from either longitudinal side of the first housing base 102 are a pair of guide walls 36. A tube boss 38 is disposed in a gap formed in either guide wall 36, as seen in FIG. 7A. A rubber tube 22 is provided around each tube boss 38. A pair of hinge members 116 protrude from the exterior surface 106 at the rear of the first housing base 102.

Figure 6:
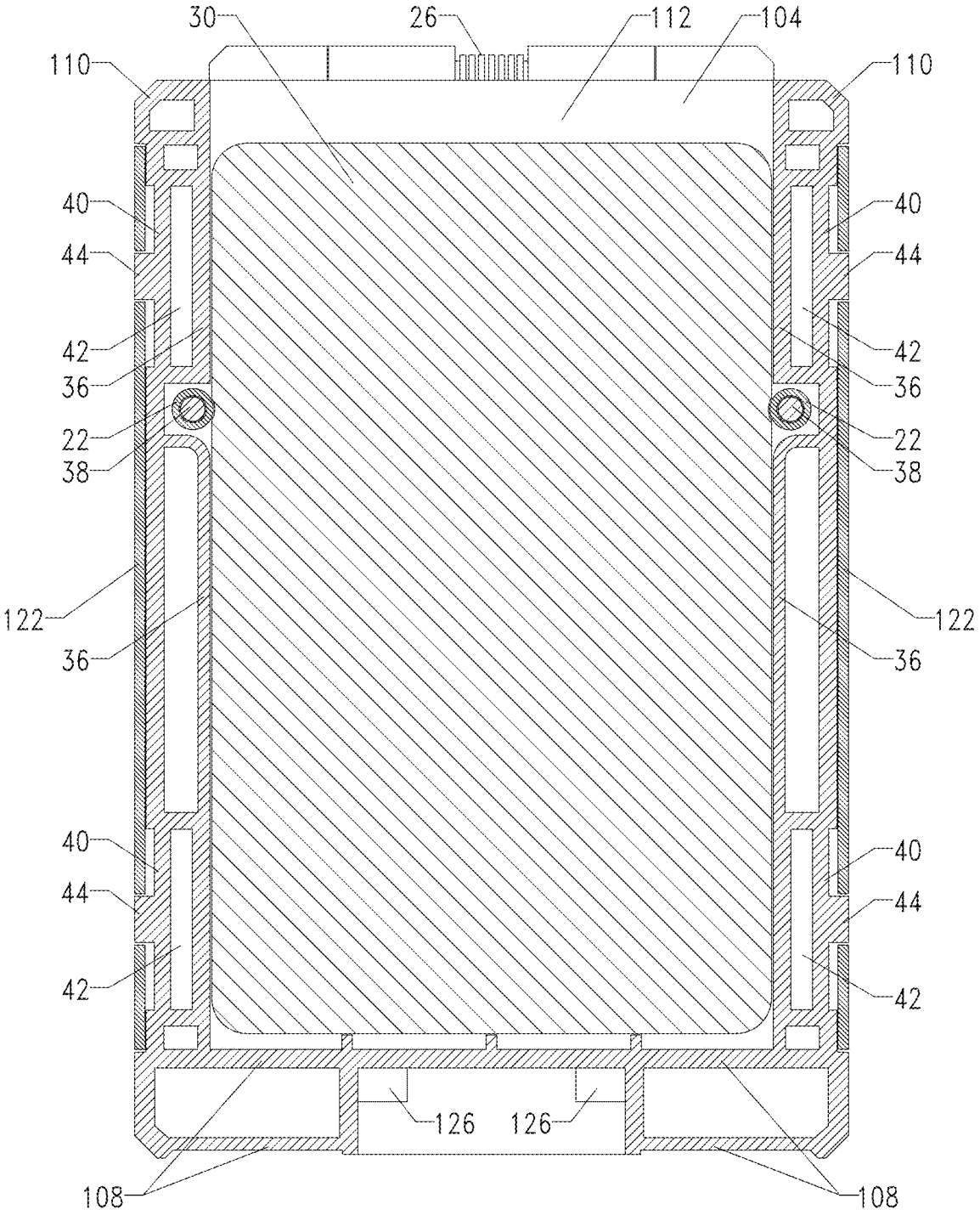
FIG. 6 is a horizontal sectional plan view taken along the lines of 6-6 of FIG. 1 through the first card chamber showing the manner in which a plurality of cards are secured inside the wallet.

Each of the longitudinal sides of the first housing base 102 comprise a pair of flexible members 40 which are connected to the guide walls 36, and a rectangular relief hole 42 is located behind each flexible member 40 (as seen in FIG. 7A and in section in FIG. 6). The relief holes 42 extend all the way through the first housing base 102 and allow the flexible members 40 to temporarily flex backwards and then return. Each flexible member 40 has a protrusion 44 extending outwardly.

The first housing cover 120, seen in FIG. 7A, has a generally rectangular planar shape and comprises a generally rectangular top portion, two longitudinal sides and two transverse ends. A finger aperture 48 is provided through the center of the top portion of the first housing cover 120. The first housing cover 120 also has a pair of side walls 122 along its longitudinal sides that are integrally formed with the top portion. Rounded exterior edges 50 extend between the top portion of the first housing cover 120 and the side walls 122, which create soft rounded edges so the wallet 300 can be comfortably held and rotated over in one's hand. The side walls 122 have apertures 46 which are sized and positioned to receive the protrusions 44 of the first housing base 102.

As suggested by FIG. 7A, the first housing cover 120 is firmly attached to the first housing base 102 by pushing the two components together and allowing the inner surfaces of the side walls 122 on the first housing cover 120 to frictionally engage with and push backwards the protrusions 44 by virtue of the flexible members 40 until the protrusions 44 are aligned with and forced through the apertures 46. When the first housing cover 120 has been attached to the first housing base 102, the first housing cover 120 substantially covers the interior surface 104, and the side walls 122 cover the longitudinal sides of the first housing base 102 by extending between the front portion 108 and the rear portion 110 to form the first card chamber 112. The first card chamber 112 is defined on its sides by the side walls 122, its back by the front portion 108, its bottom by the interior surface 104 and its top by the first housing cover 120. The rear portion 110 further comprises a first card opening 114 (seen in FIG. 7) formed therein, through which cards can be slidably inserted and removed from the first card chamber 112. The rubber tubes 22 on tube bosses 38 frictionally engage and grip the edges of cards 30 stored inside the first card chamber 112 (shown in section in FIG. 6) with enough force to hold them in place so they do not accidentally slide out of the first card opening 114. The guide walls 36, which are located inside the first card chamber 112, help guide cards into the first card chamber 112 and keep them aligned in a stack. In an alternative embodiment, the tube bosses 38 and the tubes 22 are replaced with a strip of adhesive backed rubber, felt, or fabric attached to the inner faces of guide walls 36, and frictionally engage the edges of cards inserted into the first card chamber 112. However, employing the tube bosses 38 is preferable to provide frictional engagement of cards simply because the tubes 22 are retained around them and cannot fall or peel off over time with use.

The front portion 108, the rear portion 110, and the side walls 122 all extend outwardly past and substantially perpendicular to the exterior surface 106 to form the first tray 118 (FIG. 9). A pair of card rails 124 are upstanding from and extending partially over the exterior surface 106 and are sized and positioned to retain at least one card, such as an identification card 32 as seen in FIG. 2. Any cards stored under the card rails 124 in the first tray 118 are held in place by the front portion 108 and the sloped portion of the hinge members 116, which form a ramp. Cards can be removed by placing one's finger on the top surface of the topmost card and sliding it towards and against the sloped portion of the hinge members 116 which causes the card to flex slightly above the plane of rails 124 as it slides out past hinge members 116.

Second Housing

Figure 8:
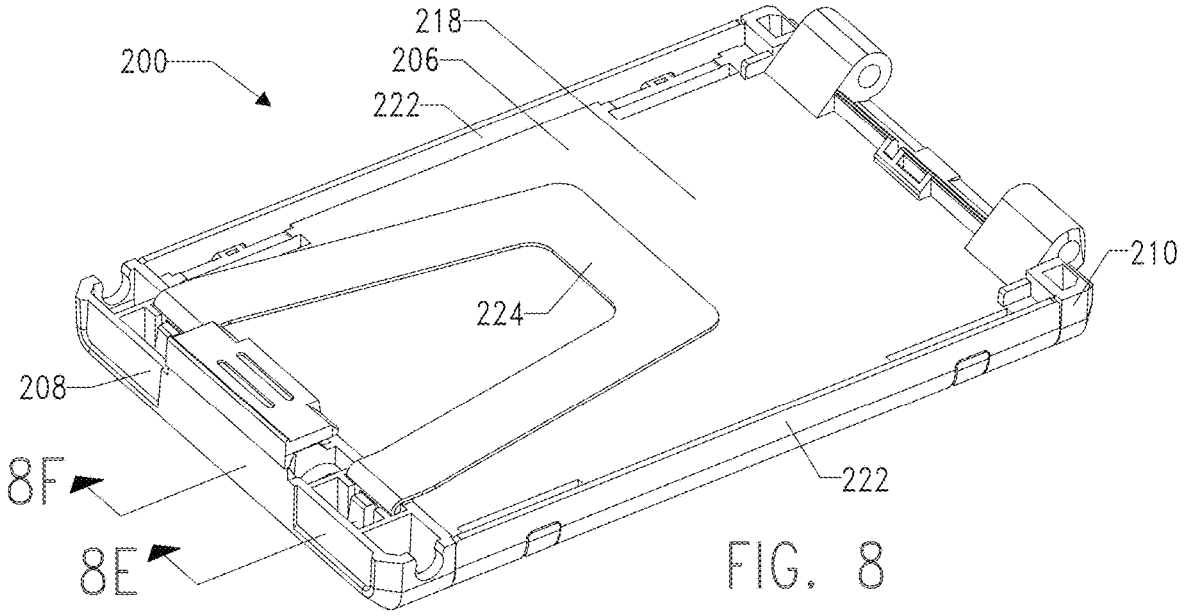
FIG. 8 a perspective view of the second housing of the wallet of FIG. 1.

The second housing 200, as seen in FIG. 8 and FIG. 9 is similar to the first housing 100 and comprises a second housing base 202 that is attached to a second housing cover 220.

The second housing base 202 (seen in FIG. 8A) has a generally rectangular planar shape and comprises two longitudinal sides and two transverse ends and has a bottom portion with an interior surface 204 (seen in FIG. 8A) and an exterior surface 206 (seen in FIG. 9). The second housing base 202 further comprises a front portion 208 and a rear portion 210. The front portion 208 and the rear portion 210 both extend vertically inwardly past interior surface 204 and outwardly past the exterior surface 206.

The bottom portion of the second housing base 202 separates a second card chamber 212 from a second tray 218, with the interior surface 204 of the bottom portion of the base 202 forming a portion of the second card chamber 212 while the exterior surface 206 of the bottom portion of the base 202 forms a portion of the second tray 218.

Figure 8A:
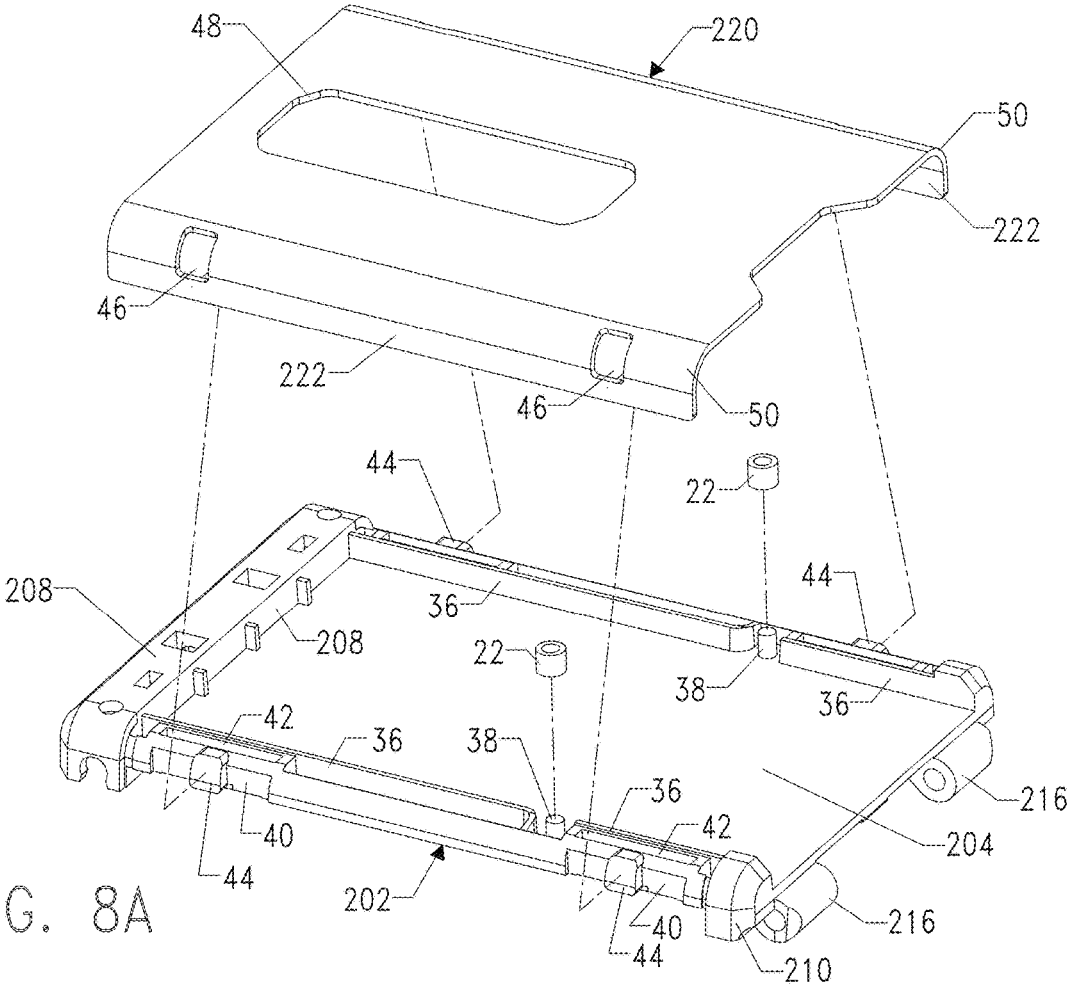
FIG. 8A is a partially exploded perspective view of the second housing of FIG. 8 showing how the rubber tubes and second housing cover are attached and fastened to the second housing base.

Proximate to and spaced from either longitudinal side of the second housing base 202 are a pair of guide walls 36. A tube boss 38 is disposed in a gap formed in either guide wall 36, as seen in FIG. 8A. A rubber tube 22 is provided around each tube boss 38. A pair of hinge members 216 protrude from the exterior surface 206 at the rear of the second housing base 202.

Each of the longitudinal sides of the second housing base 202 comprise a pair of flexible members 40 which are connected to the guide walls 36, and a rectangular relief hole 42 is located behind each flexible member 40 (as seen in FIG. 8A). The relief holes 42 extend all the way through the second housing base 202 and allow the flexible members 40 to temporarily flex backwards and then return. Each flexible member 40 has a protrusion 44 extending outwardly.

The second housing cover 220, seen in FIG. 8A, has a generally rectangular planar shape and comprises a generally rectangular top portion, two longitudinal sides and two transverse ends. A finger aperture 48 is provided through the center of the top portion of the second housing cover 220. The second housing cover 220 also has a pair of side walls 222 along its longitudinal sides that are integrally formed with the top portion. Rounded exterior edges 50 extend between the top portion of the second housing cover 220 and the side walls 222, which create soft rounded edges so the wallet 300 can be comfortably held and rotated over in one's hand. The side walls 222 have apertures 46 which are sized and positioned to receive the protrusions 44 of the second housing base 202.

As suggested by FIG. 8A, the second housing cover 220 is firmly attached to the second housing base 202 by pushing the two components together and allowing the inner surfaces of the side walls 222 on the second housing cover 220 to frictionally engage with and push backwards the protrusions 44 by virtue of the flexible members 40 until the protrusions 44 are aligned with and forced through the apertures 46. When the second housing cover 220 has been attached to the second housing base 202, the second housing cover 220 substantially covers the interior surface 204, and the side walls 222 cover the longitudinal sides of the second housing base 202 by extending between the front portion 208 and the rear portion 210 to form the second card chamber 212. The second card chamber 212 is defined on its sides by the side walls 222, its back by the front portion 208, its bottom by the interior surface 204 and its top by the second housing cover 220. The rear portion 210 further comprises a second card opening 214 (seen in FIG. 1A) formed therein, through which cards can be slidably inserted and removed from the second card chamber 212. The rubber tubes 22 on tube bosses 38 frictionally engage and grip the edges of cards 30 stored inside the second card chamber 212 (very similar to the first card chamber 112 in FIG. 6) with enough force to hold them in place so they do not accidentally slide out of the first card opening 214. The guide walls 36, which are located inside the second card chamber 212, help guide cards into the second card chamber 212 and keep them aligned in a stack. In an alternative embodiment, the tube bosses 38 and the tubes 22 are replaced with a strip of adhesive backed rubber, felt, or fabric attached to the inner faces of guide walls 36, and frictionally engage the edges of cards inserted into the second card chamber 212. However, employing the tube bosses 38 is preferable to provide frictional engagement of cards simply because the tubes 22 are retained around them and cannot fall or peel off over time with use.

The front portion 208, the rear portion 210, and the side walls 222 all extend outwardly past and substantially perpendicular to the exterior surface 206 to form the second tray 218 (FIG. 9).

Figure 8B:
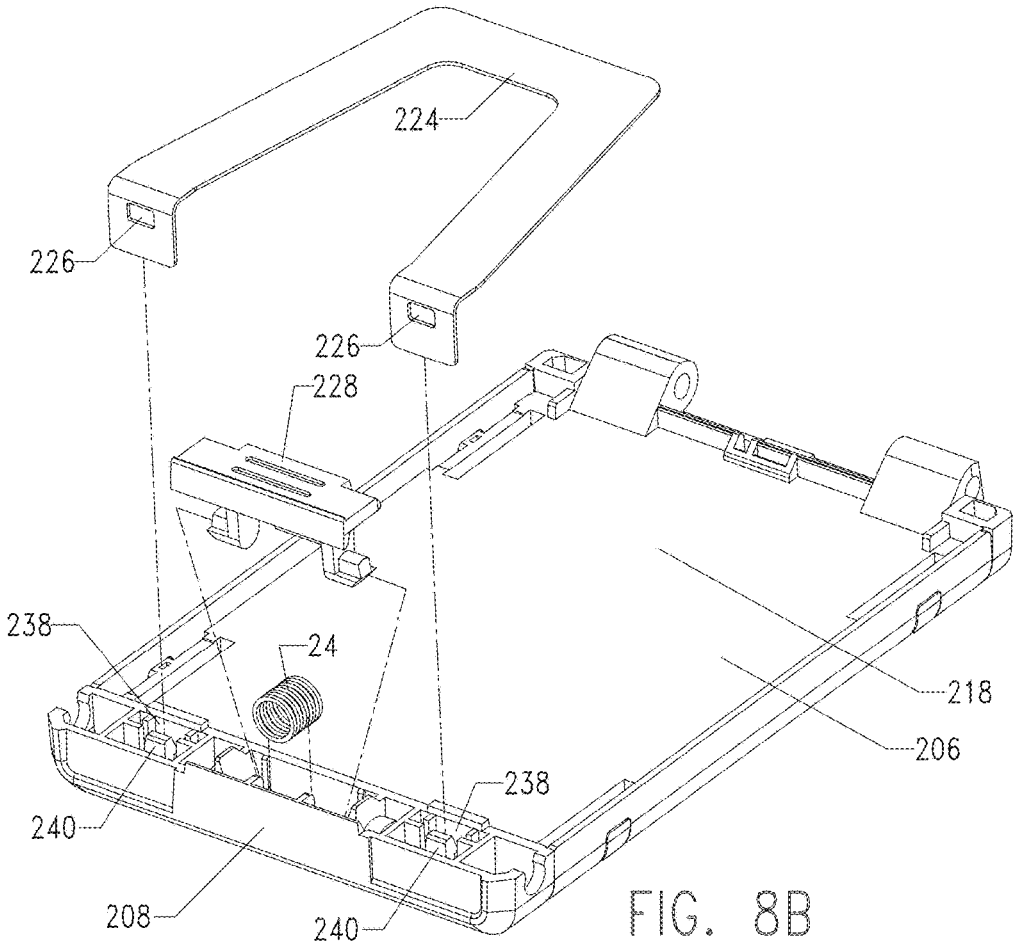
FIG. 8B is a partially exploded perspective view of the second housing of FIG. 8 showing how the compression spring and latch member are inserted into a hollow area of the front portion of the second housing base, as well as how the clip snaps into place.
Figure 8C:
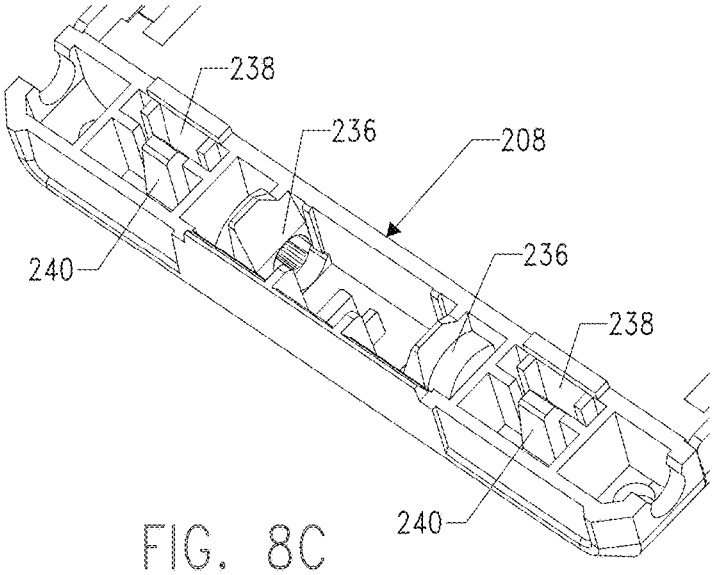
FIG. 8C is an enlarged partial perspective view of the front portion of the second housing of FIG. 8 showing the latch member base, retaining channels for clip and the snap fits to help keep the clip in place.

As seen in FIGS. 8B and 8C, the front portion 208 comprises a pair of retaining channels 238 that each have a snap fit 240 in their center.

The clip 224 comprises a thin, flat body with an approximate U-shape and two ends each bent downwardly and perpendicular to the body of the clip. Each end is provided with an aperture 226.

To assemble the clip 224 to the front portion 208 of the second housing base 202, the bent ends of clip 224 are inserted into retaining channels 238 (as seen in FIG. 8B) which causes snap fits 240 to flex backwards until they are aligned with and spring back through apertures 226 (shown in section in FIG. 8E), which securely holds clip 224 in place as the clip 224 extends over the top of the second tray 218.

Figure 5:
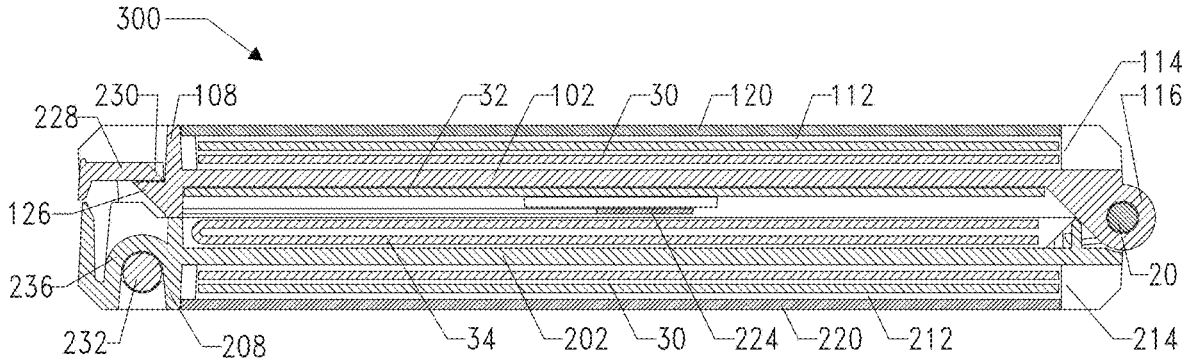
FIG. 5 is a vertical sectional view taken along the line 5-5 of FIG. 1, the wallet being in a closed position and the latch member being in a locked position.
Figure 5A:
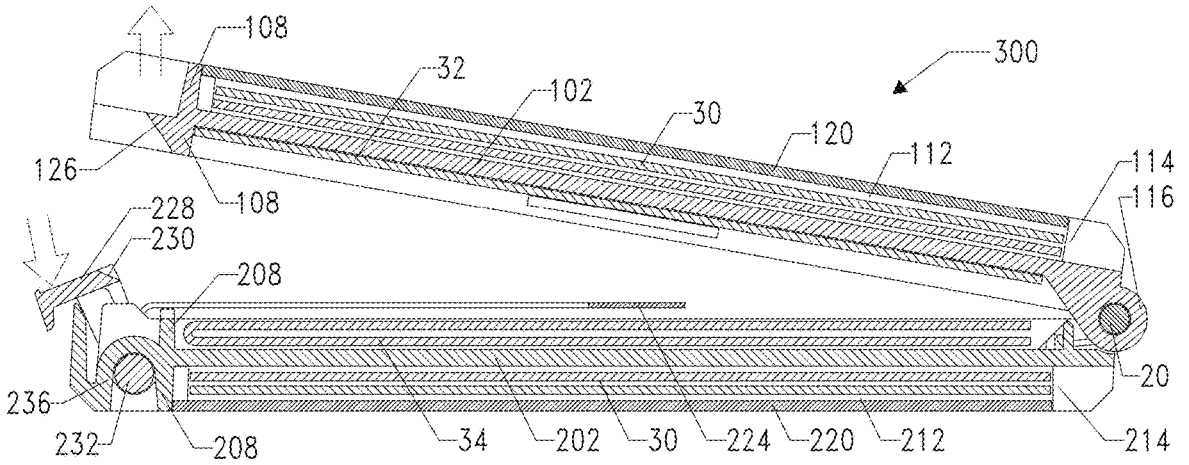
FIG. 5A is a vertical sectional view similar to FIG. 5 except for the wallet being in a partially open position with the first housing being rotated upward, and the latch member being in an unlocked position.

In the preferred embodiment, the clip 224 does not contact the exterior surface 206, so that paper currency, receipts, tickets, business cards, or regular cards may easily be slid underneath it and into second tray 218 (seen best in FIG. 5A). Contents stored in second tray 218 are sandwiched between clip 224 and exterior surface 206 and are held in place on their sides by the ends of side walls 222, front portion 208 and rear portion 210.

In an alternate embodiment, the clip 224 is secured to the second housing base 202 with screws instead of using the snap fits 240 (not shown). In another embodiment, the clip 224 is pivotably mounted to the second housing base 202 so that a user could lift the clip 224 up to insert or remove contents in the second tray 218 (not shown).

As seen in FIG. 8C, the front portion 208 further comprises a pair of latch member bases 236 that each have a wall with an inwardly facing slope and a horizontal hole formed at the bottom.

Figure 8D:
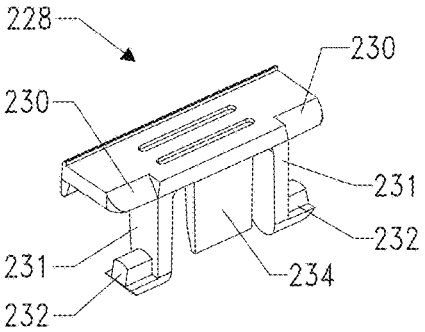
FIG. 8D is an enlarged perspective view of the latch member showing all of its respective elements.
Figure 8E:
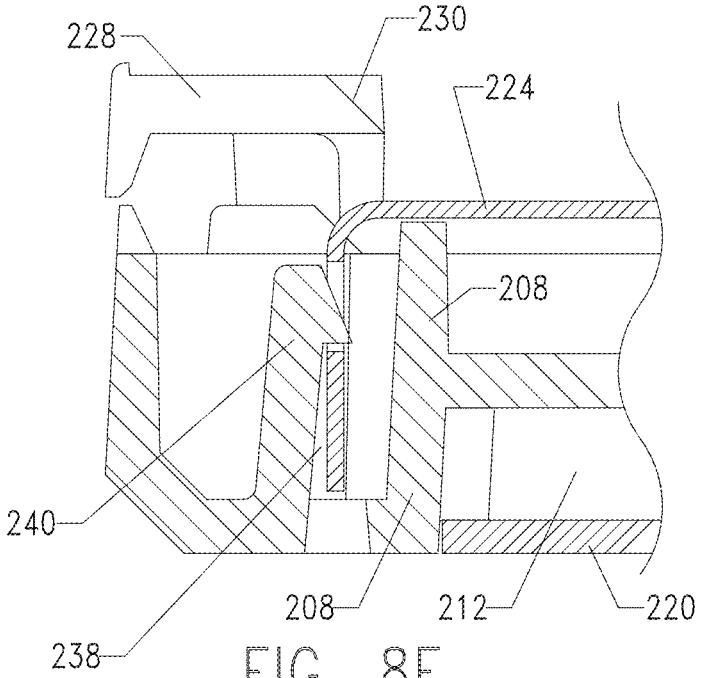
FIG. 8E is an enlarged partial vertical sectional view of the second housing of FIG. 8 taken along the lines 8E-8E showing how the clip is held in place against the snap fit.
Figure 8F:
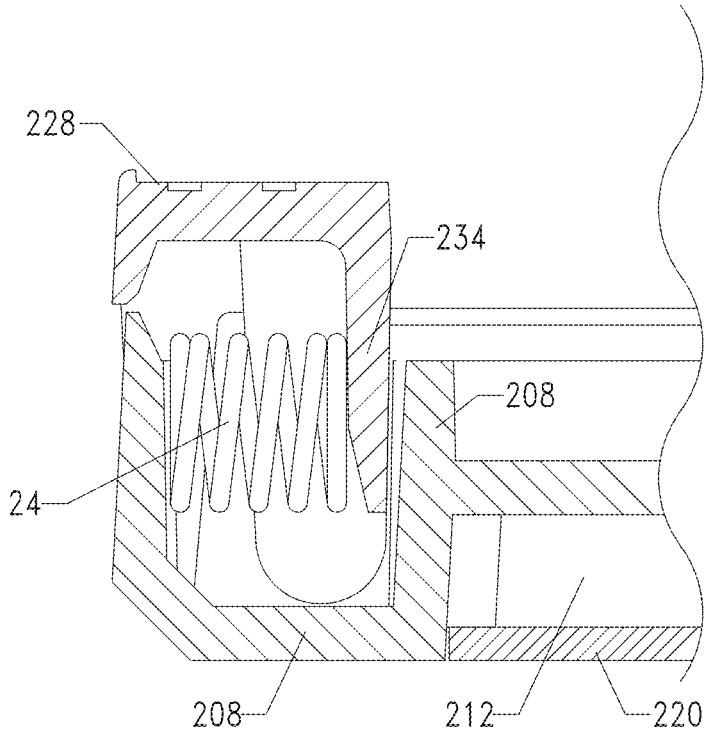
FIG. 8F is an enlarged partial vertical sectional view of the second housing of FIG. 8 taken along the lines 8F-8F showing how the compression spring sits between the wall of the latch member and a wall of the front portion of the second housing, keeping the latch member urging backwards.

The latch member 228, seen in FIG. 8D, as installed in the wallet 300, has a locked position (FIGS. 5 AND 8F) and an unlocked position (FIG. 5A). The latch member 228 has a rectangular planar shape and comprises tongue overlapping portions 230 on two of its sides, a wall 234 extending downwards, and a pair of semi-flexible legs 231 extending downwards. At the distal ends of the legs 231 are hinge rods 232 which protrude outwards. As suggested by FIG. 8B, during assembly, the compression spring 24 is inserted into the front portion 208 and is positioned between the latch member bases 236. As the latch member 228 is inserted into the latch member bases 236, the wall 234 extending from underneath the latch member 228 is inserted between a back wall of front portion 208 and the compression spring 24 (seen in section in FIG. 8F) and hinge rods 232 engage the sloped walls of the latch member bases 236 and cause the legs 231 to temporarily flex inwards until the hinge rods 232 are aligned with and forced through the holes in the latch member bases 236. The compression spring 24 presses against the wall 234 and keeps the latch member 228 in its locked position when not being engaged (seen in section in FIG. 8F).

Fully Assembled Wallet

As seen in FIG. 9, the first housing 100 and the second housing 200 are rotatably linked by a hinge pin 20 inserted through the holes in hinge members 116 on the first housing 100 and the hinge members 216 on the second housing 200.

Preferably, the holes in the hinge members 216 have a hole diameter that is slightly less than the diameter of the hinge pin 20 so the hinge members 216 frictionally engage and hold the hinge pin 20 in place (similar to a 'press fit') so the hinge pin 20 does not slide out. The hinge pin 20 also passes through the center of a torsion spring 26 which sits in between the hinge members 116. The two legs of the torsion spring 26 urge against a portion of the exterior surface 106 and the exterior surface 206 and keeps the first housing 100 and the second housing 200 constantly urged away from each other.

Thus, it will be observed that wallet 300 has two basic positions:

(i) Closed Position (FIGS. 1, 1A, 3, 3A, 4, and 5):

As the first housing 100 is pivoted closed against the second housing 200, a pair of projecting tongues 126 (seen in FIG. 9 and in section in FIGS. 5 and 5A) frictionally engage the tongue overlapping portions 230 on the latch member 228 and cause the latch member 228 to temporarily pivot backwards. As the projecting tongues 126 continue to move downwards past the tongue overlapping portions 230, the urging force of the latch member 228 moves the tongue overlapping portions 230 to the top of the projecting tongues 126 and allows the wallet 300 to be securely locked shut.

In a presently preferred embodiment, the first housing cover 120 and the second housing cover 220 are made from a substantially rigid material with strong electromagnetic/RFID shielding properties, which not only helps prevent cards stored inside the wallet 300 from being crushed or bent, but also prevents them from being scanned by an RFID card reader. Moreover, in the presently preferred embodiment, the housing covers 120 and 220 have a minimum thickness of 0.020 inches to help ensure the housing covers are rigid and resilient enough to substantially prevent external compressive forces from crushing or cracking cards stored inside the wallet 300.

In the closed position, any cards stored inside the wallet 300 are effectively sandwiched between the first housing cover 120 and the second housing cover 220 and are therefore shielded from RFID scanning. Moreover, RFID-enabled cards stored inside the wallet 300 are also more effectively shielded than prior art because the first housing cover 120 and the second housing cover 220 have side walls 122 and 222 respectively which completely wrap around the sides of the wallet 300 and come into close proximity with one another to provide a much more encompassing electromagnetic shielding effect around all cards.

Furthermore, while in the closed position, the side walls 122 on the first housing cover 120 and the side walls 222 on the second housing cover 220 come into close proximity with one another (seen in FIGS. 1, 1A, and in section in FIG. 4) and physically prevents contents held in the first tray 118 or the second tray 218 from falling out of the wallet 300.

Figure 3:
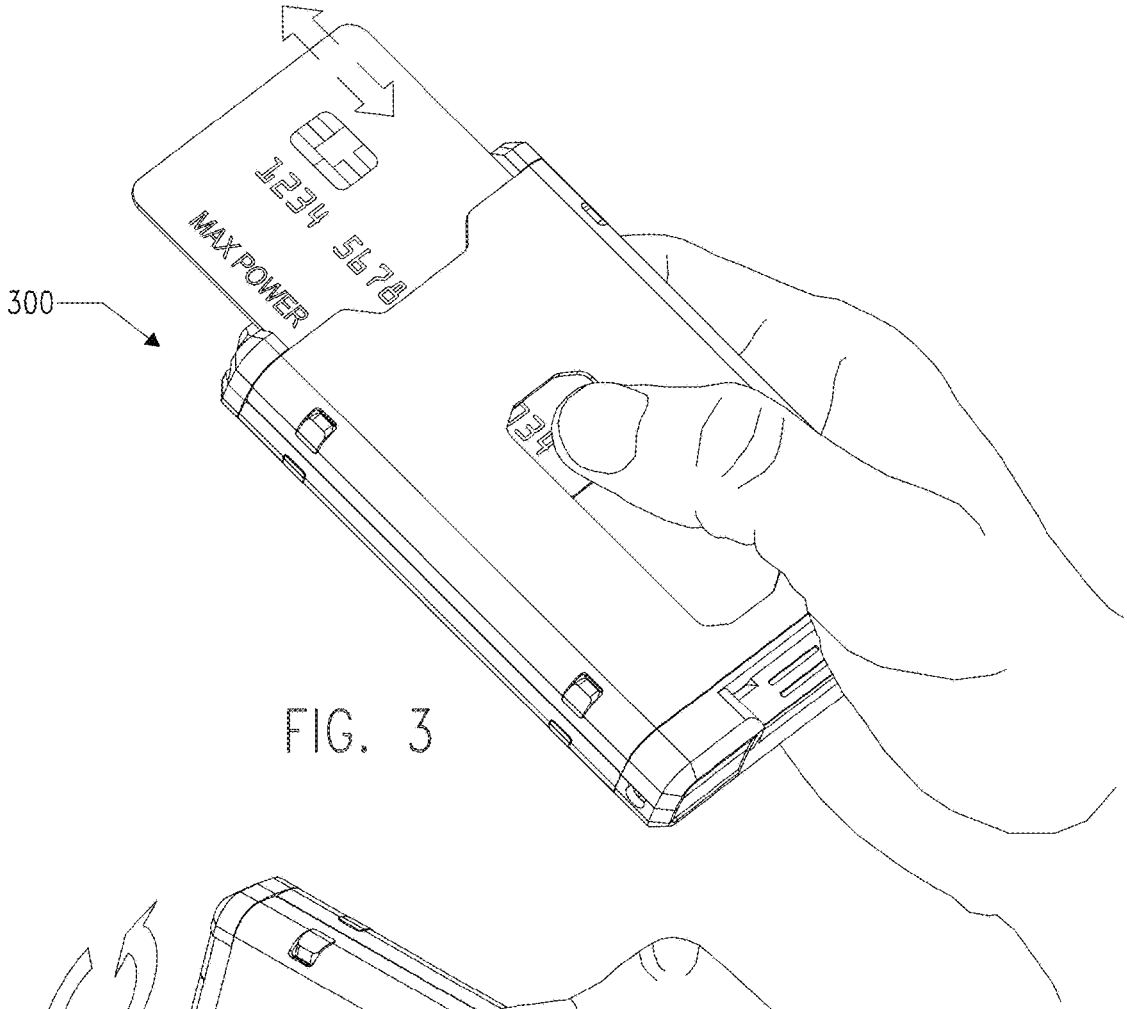
FIG. 3 is a perspective isometric view of the wallet of FIG. 1 illustrating a credit card being ejected out of the wallet by a user.

While holding the wallet 300 in the palm of one's hand in its closed position, the topmost card in a stack of cards inside the first card chamber 112, which should be one of the user's most frequently used cards, is easily ejected out through the card opening 114 by placing one's finger through the finger aperture 48 and pushing the topmost card out (seen in FIG. 3). Cards stored underneath the topmost card in the first card chamber 112 are easily accessed by pushing out the topmost card first until the finger aperture 48 shows the next card underneath, at which point that card can also be pushed out with one's finger and accessed underneath the topmost card which is already partially ejected from the card opening 114. The process is repeated for each subsequent card remaining in the stack. Cards stored in the second card chamber 212 are removed and sorted through exactly the same as cards stored in the first card chamber 112.

Figure 3A:
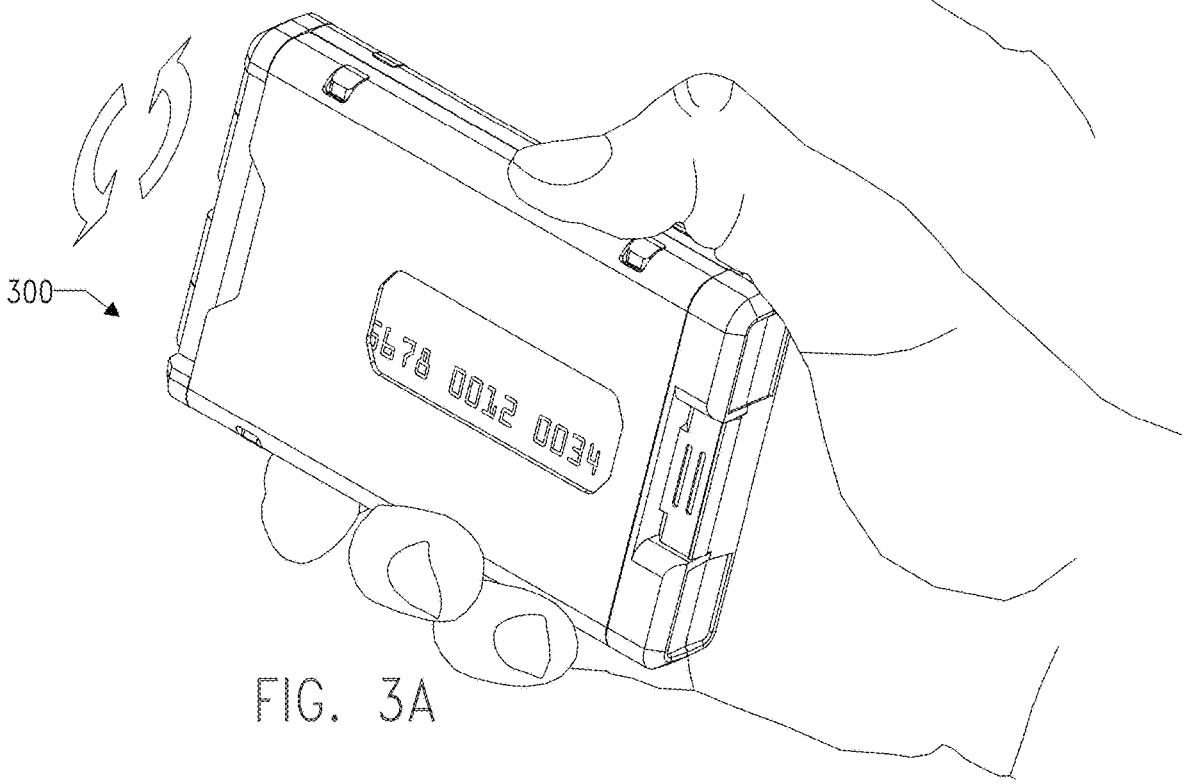
FIG. 3A is a perspective isometric view of the wallet of FIG. 1 showing the wallet being rolled over on its longitudinal axis by a user in order to access cards on the rear of the wallet.
Figure 4:
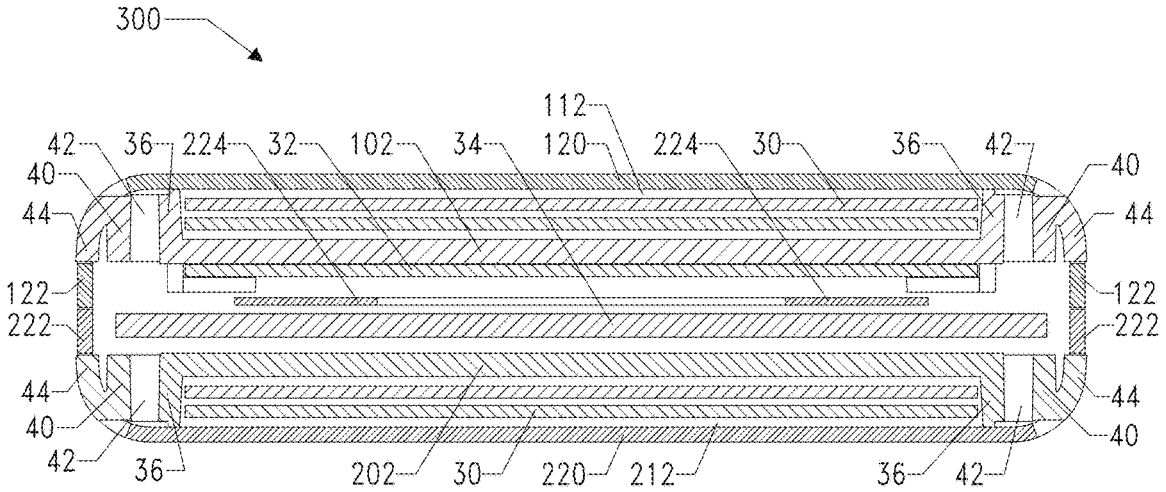
FIG. 4 is a vertical section taken along the line 4-4 of FIG. 1, the wallet being in a closed position and the latch member being in a locked position.

While in the closed position, rounded exterior edges 50 on the edges of the first housing cover 120 and the second housing cover 220 create a soft ergonomic form factor and allows a user to easily roll the wallet 300 over in one's hand with their fingers (as seen in FIG. 3A) to alternate between accessing cards stored in the first card chamber 112 or the second card chamber 212. Moreover, this vertical card ejecting and shuffling mechanic is very fast and intuitive for a user, mimicking the same gesture millions of people already use when scrolling up or down with their thumbs while on their mobile phones. In another embodiment each housing cover is provided with a chamfer on their edges instead of rounded exterior edges 50, which also helps create an ergonomic form factor (not shown). In a presently preferred embodiment, the rounded exterior edges 50 have a minimum diameter of 0.040 inches to help ensure the edges of wallet 300 are comfortable to hold and maneuver while in one's hand and excludes any sharp edges.

In another embodiment, the finger apertures 48 on the first and second housing covers are omitted and an ejection assembly is used to eject cards (U.S. Pat. No. 8,899,411, incorporated herein by reference). Other such wallets can use ejection assemblies typically consisting of a one-piece housing with a spring-loaded lever arm pivotably mounted inside the housing at the back of the card chamber which is able to be rotated in various ways to push the stack of cards out.

Figure 11:
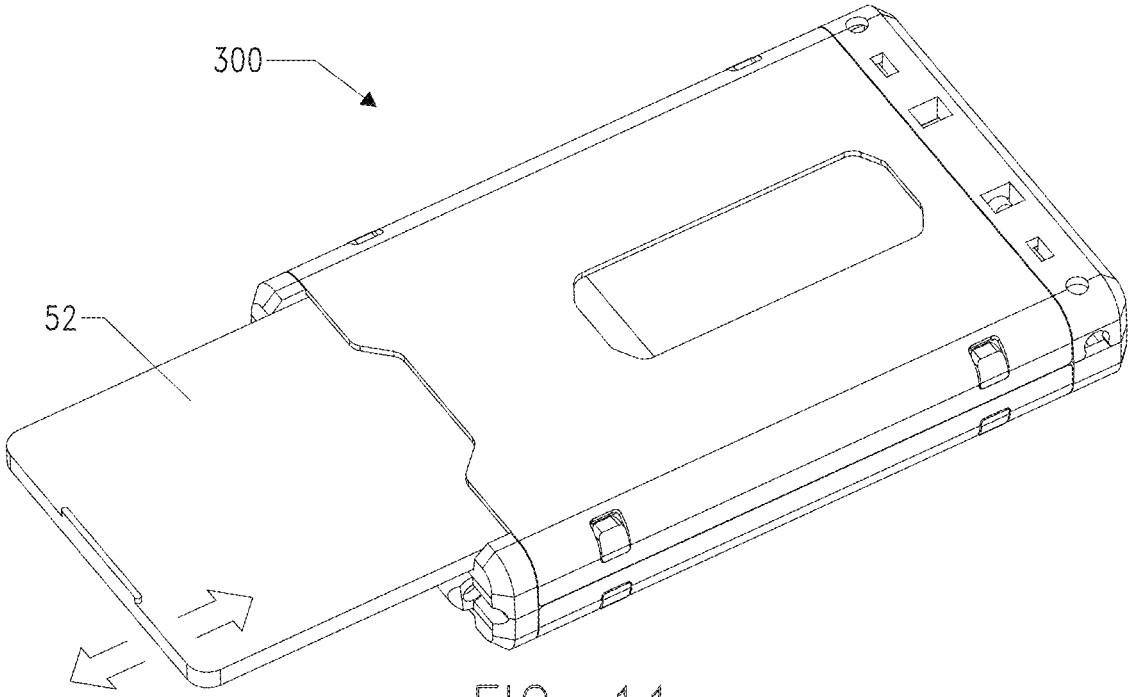
FIG. 11 is a perspective isometric view of the rear side of the wallet of FIG. 1 shown in the closed position when the drawer is inserted or removed from the second card chamber through the second card opening.
Figure 11A:
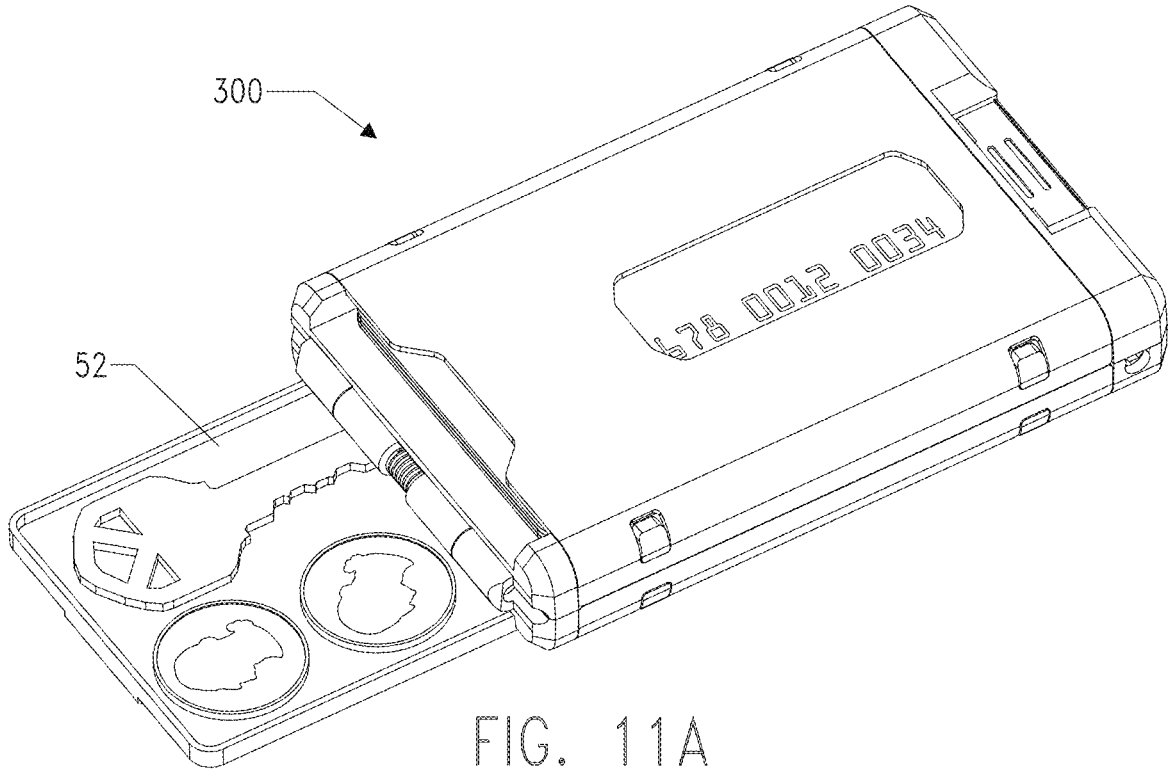
FIG. 11A is a perspective isometric view of the front side of the wallet of FIG. 1 shown in the closed position when the drawer is partially ejected from the second card chamber and showing small articles that can be held in the drawer.

In another embodiment, at least one of the card chambers is able to receive a drawer 52 instead of cards. As seen partially inserted into the second card chamber in FIGS. 11 and 11A, the drawer 52 has a generally rectangular planar shape and is able to store small articles inside such as coins, keys, medication and the like. The rubber tubes 22 in the card chambers grip the sides of the drawer 52 to securely hold it in place inside its respective card chamber, or an alternative detent means could be used to secure the drawer inside one of the card chambers. A user may eject the drawer 52 with their finger using the finger apertures on each housing cover, or the drawer 52 could be manually pulled out from the card opening of its respective card chamber.

(ii) Open Position (FIG. 2):

From its closed position, the wallet 300 will automatically unlock and pivot itself open by pushing down and backwards on the top surface of the latch member 228 which causes the tongue overlapping portions 230 to be moved away from the projecting tongues 126 on the first housing base 102, as seen in section in FIG. 5A. The urging force of the torsion spring 26 then forces the front housing 100 to pivot open approximately 180 degrees and lie in the same general plane as the second housing 200, as seen in FIG. 2. While in the open position, contents stored in the first tray 118 or the second tray 218 can be accessed. Thus, the torsion spring 26 helps the wallet 300 flip open and hold itself open for the user. In another embodiment of the invention, the torsion spring 26 is omitted and the user manually pivots open the first housing 100 after pulling backwards on the latch member 228. In another embodiment of the invention, both the latch member 228 and the torsion spring 26 are omitted and a plurality of magnets is used inside each housing's respective front portion to allow a user to easily snap the wallet closed and gently pry it open when access to the first tray or second tray is needed (not shown), with the magnets acting as a lock.

Materials and Manufacturing

In a preferred embodiment, the first housing cover 120 and the second housing cover 220 are stamped and formed from a uniform sheet of substantially rigid metal alloy such as aluminum, titanium, or steel. A carbon fiber reinforced material can also be used. Aluminum alloy has strong inherent RFID shielding properties and is lightweight, rigid, resilient, and readily available. It is also one of the most recyclable materials, making it a "greener" material. The lightness of the material chosen is also favorable as the wallet 300 is meant to be comfortably carried in one's pocket or handbag. If the first housing cover 120 and the second housing cover 220 were made from aluminum, they would also be able to undergo an anodizing process resulting in different colors to satisfy new trends, demands and tastes of the market.

Also in a preferred embodiment, the first housing base 102, the second housing base 202 and the latch member 228 are all injection molded from a durable, lightweight, and resilient plastic such as ABS or polycarbonate.

In a preferred embodiment, the first housing cover 120 and the second housing cover 220 are attached to their respective housing bases 102 and 202 using flexible members 40 and protrusions 44, without the use of any fasteners, screws, adhesive or welding. This makes wallet 300 easier to manufacture than most competing products in the market. In another embodiment, housing covers 120 and 220 are attached to their respective bases using screws or other fasteners.

Moreover, in yet another embodiment, the first housing base 102 and the first housing cover 120, as well as the second housing base 202 and the second housing cover 220, are formed integrally together so they are one piece, such as by a metal molding process, a CNC machining process, or making each of the housings as an extruded aluminum part and attaching additional components to them, with each housing simply having a top portion instead of a housing cover that needs to be attached separately.

The hinge pin 20 is preferably made from a strong, rigid material such as steel, helping to keep the hinge members 116 and 216 in line with each other at all times. The clip 224 is preferably made from a thin but substantially rigid and resilient metal such as heat-treated steel, so that it provides strength but takes up little thickness.

The rubber tubes 22 are also preferably made from a resilient silicone rubber that has excellent durability, resilience, and gripping qualities.

Figure 10:
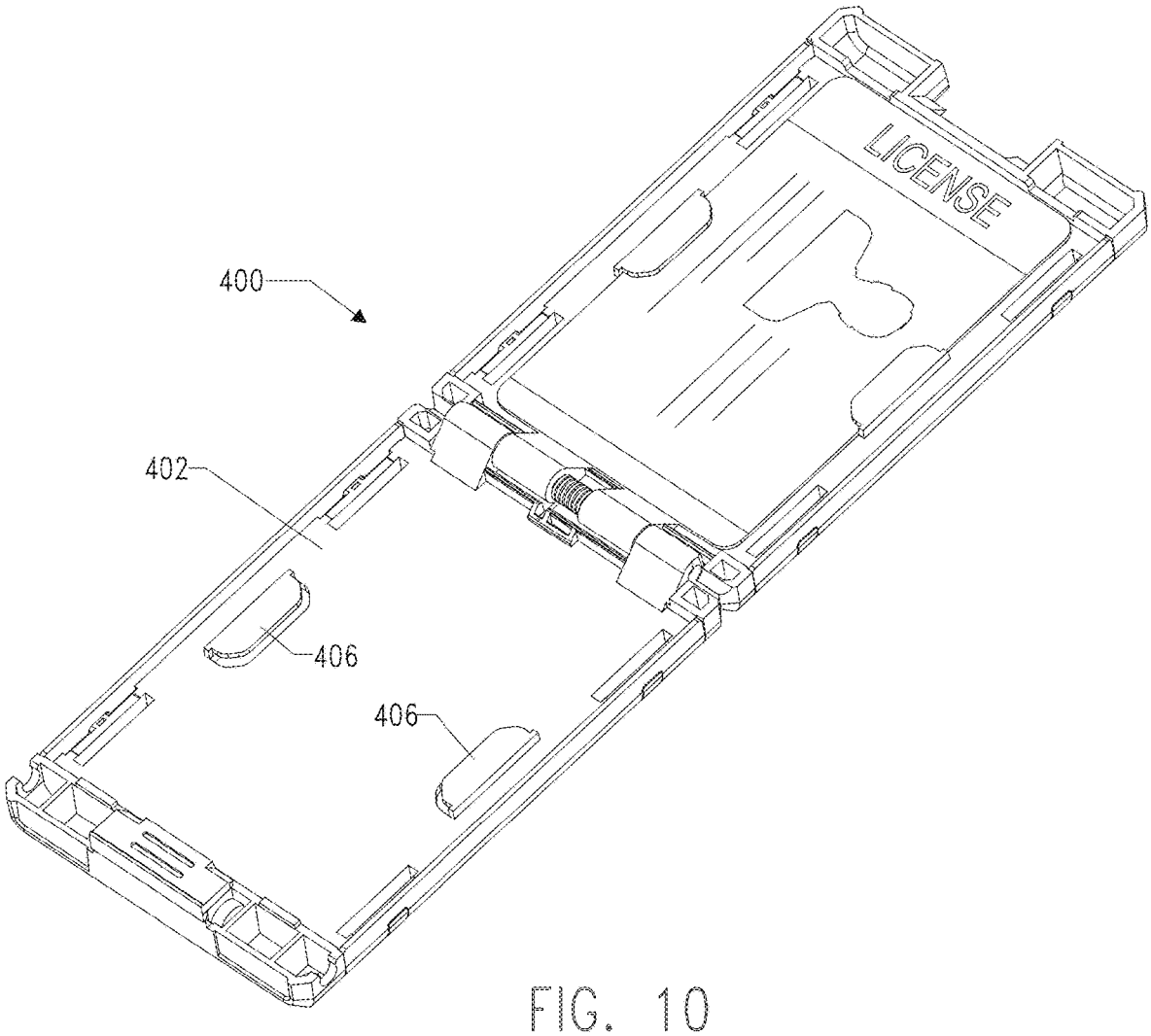
FIG. 10 is a perspective isometric view of the second embodiment of the wallet shown in a fully open position as seen from above.

A second embodiment of the wallet of the present invention is shown in FIG. 10 and broadly denoted by the numeral 400. This embodiment differs from the presently preferred embodiment in that the second housing base 202 is replaced with a new housing base 402 which omits the clip 224, the retaining channels 238 and the snap fits 240, and includes a new set of card rails 406 to its respective tray, thus allowing two dedicated card slots on the interior of the wallet instead of one.

This second embodiment would be useful for users who do not want to carry cash, but want more card storage inside the wallet.

More broadly, the present invention permits many kinds of holding means can be implemented to retain items on the first tray 118 and/or the second tray 218. For example, the clip 224 could have a means for attachment to the first tray 118 while the second tray 218 has a card holding means, with more variations possible.

The present invention thus provides an ergonomic quick access wallet that can be used to quickly access cards on both of its sides with minimal complication or deterrence, as well as discreetly hold and protect paper currency, additional cards and more in its interior. Furthermore, in some embodiments, the wallet has several additional advantages such as:

- All cards stored inside the wallet are shielded from unauthorized RFID scanning, preventing what is known in the industry as RFID theft or skimming;
- Instead of using thin, flimsy electromagnetic shielding foil like some prior art, the housing covers on the wallet are made from substantially rigid RFID protective metal which prevents a breach from forming in the RFID shielding effect;
- The construction and materials selected to manufacture the wallet allow it to be substantially rigid and crush resistant, protecting all the cards inside from being crushed, bent, or cracked;
- The rounded exterior edges on the edges of the housings create a soft geometric shape and profile for the wallet and allows it to be comfortably held and rotated over in one's hand;
- Very sensitive and important cards such as a driver's license can be safely and discreetly stored inside the wallet under card rails, allowing a user to clearly display their ID card or license without having to remove it from the wallet;
- The resilient rubber tubes on the insides of each card chamber engage and grip the sides of a stack of cards and does not let them accidentally fall out, yet allows a user to quickly access a card by pushing it out with their thumb, without the need or complication of having to open or unlock anything, or use awkward and unreliable ejector mechanisms;
- Using one's thumb to vertically remove cards from each of the card chambers is fast and intuitive, mimicking the same gesture millions of people already use when scrolling up or down with their thumbs while on their mobile phones;
- In the closed position, the wallet uses a releasable locking means to stay shut and cannot accidentally open while shifting around in one's pocket or bag, keeping articles such as your ID or license, paper currency and other items stored inside secure;
- The torsion spring on the hinge assists a user in opening the wallet after they engage the latch member, as well as keeps the wallet held open while the user accesses the contents inside each tray;
- The spring-loaded latch member will automatically lock the wallet shut when a user closes the first housing against the second housing, further highlighting the speed and intuitiveness for the user;
- The first and second tray covers, if made from aluminum, can be anodized in different colors to meet the current trends, demands and tastes of the market.

It will be appreciated that still further embodiments of the present invention will be apparent to those skilled in the art in view of the present disclosure. It is to be understood that the present invention is by no means limited to the particular constructions herein disclosed and/or shown in the drawings, but also comprises any modifications or equivalents within the scope of the invention. Accordingly, the scope of the invention should be determined not by the embodiment illustrated, but by the appended claims and their legal equivalents.

REFERENCE NUMERALS

20 hinge pin
22 rubber tubes
24 compression spring
26 torsion spring
30 cards
32 identification card
34 paper currency
36 guide walls
38 tube boss
40 flexible member
42 relief hole
44 protrusions
46 apertures in housing covers
48 finger apertures
50 rounded exterior edges
52 drawer
100 first housing
102 first housing base
104 interior surface of first housing base
106 exterior surface of first housing base
108 front portion of first housing base

110 rear portion of first housing base
112 first card chamber
114 first card opening
116 hinge members on first housing base
118 first tray
120 first housing cover
122 side walls on first housing cover
124 card rails on first tray
126 projecting tongues on front portion
200 second housing
202 second housing base
204 interior surface of second housing base
206 exterior surface of second housing base
208 front portion of second housing base
210 rear portion of second housing base
212 second card chamber
214 second card opening
216 hinge members on second housing base
218 second tray
220 second housing cover
222 side walls on second housing cover
224 clip
226 apertures in clip
228 latch member
230 tongue overlapping portion on latch member
231 button legs
232 hinge rods on latch member legs
234 wall under latch member
236 latch member bases
238 retaining channel for clip
240 snap fits in retaining channel
300 wallet
400 second embodiment of wallet
402 second embodiment of second housing base
406 card rails on second embodiment

The invention claimed is:

1. An ergonomic quick access wallet comprising:

a first and second housing;

the first housing comprising:

(a) a first housing base having a generally rectangular shape with two longitudinal sides and two transverse ends, the first housing base having a bottom portion, a rear portion, and a front portion, the bottom portion of the first housing base having an interior surface and an exterior surface;

the first housing base including a pair of guide walls proximate to and spaced from either longitudinal side of the first housing base;

at least one of the sides of the first housing base comprising flexible members, each flexible member having a protrusion extending outwardly;

each flexible member having a relief hole located behind each flexible member allowing each flexible member to flex backward;

(b) a first housing cover having a generally rectangular planar shape with two longitudinal sides and two transverse ends, the first housing cover further comprising a top portion and a pair of side walls upstanding from the two longitudinal sides of the first housing cover;

the side walls of the first housing cover including apertures receiving the protrusions of the first housing base to attach the first housing cover to the first housing base;

wherein the first housing cover is attached to the first housing base, the first housing cover substantially covering the interior surface and the two longitudinal sides of the first housing base, the side walls of the first housing cover extending between the front portion and the rear portion of the first housing base to form a first card chamber, the first card chamber being configured to receive at least one card, the interior surface of the bottom portion of the first housing base forming a surface of the first card chamber;

wherein the rear portion of the first housing base has a first card opening formed therein configured to allow cards to pass through the first card opening and into and out of the first card chamber;

wherein the front portion and the rear portion of the first housing base as well as the side walls of the first housing cover each extend past and substantially perpendicular to the bottom portion of the first housing base and, together with the exterior surface of the bottom portion of the first housing base form a first tray for receiving contents;

the second housing comprising:

(a) a second housing base having a generally rectangular shape with two longitudinal sides and two transverse ends, the second housing base having a bottom portion, a rear portion, and a front portion, the bottom portion of the second housing base having an interior surface and an exterior surface;

the second housing base including a pair of guide walls proximate to and spaced from either longitudinal side of the second housing base;

at least one of the sides of the second housing base comprising flexible members, each flexible member having a protrusion extending outwardly;

each flexible member having a relief hole located behind each flexible member allowing each flexible member to flex backward;

(b) a second housing cover having a generally rectangular planar shape with two longitudinal sides and two transverse ends, the second housing cover further comprising a top portion and a pair of side walls upstanding from the two longitudinal sides of the second housing cover;

the side walls of the second housing cover including apertures receiving the protrusions of the second housing base to attach the second housing cover to the second housing base;

wherein the second housing cover is attached to the second housing base, the second housing cover substantially covering the interior surface and the two longitudinal sides of the second housing base, the side walls of the second housing cover extending between the front portion and the rear portion of the second housing base to form a second card chamber, the second card chamber being configured to receive at least one card, the interior surface of the bottom portion of the second housing base forming a surface of the second card chamber;

wherein the rear portion of the second housing base has a second card opening formed therein configured to allow cards to pass through the second card opening and into and out of the second card chamber;

wherein the front portion and the rear portion of the second housing base as well as the side walls of the second housing cover each extend past and substantially perpendicular to the bottom portion of the second housing base and, together with the exterior surface of the bottom portion of the second housing base form a second tray for receiving contents;

a hinge joining the first and second housings, the housings being rotatable about the hinge between an open position and a closed position;

wherein in the closed position the front portion of the first housing comes into close proximity to the front portion of the second housing and the rear portion of the first housing comes into close proximity to the rear portion of the second housing and the ends of each pair of the side walls come into close proximity to each other and retain any contents stored in the first or second tray;

and wherein while in the closed position the exterior surfaces of the bottom portions of the first and second housing bases face each other;

a lock for securing the first housing closed against the second housing to keep the wallet in the closed position; and wherein the first and second housing covers are made from a substantially rigid RFID protective material.

2. The wallet according to claim 1, wherein at least one of the first and second card chambers comprises at least one resilient means for frictionally engaging cards within the respective card chamber, the resilient means being disposed in a gap in a guide wall.

3. The wallet according to claim 1, wherein at least one of the top portions of the first and second housing covers comprises a finger aperture formed therethrough for slidably ejecting cards through the card openings.

4. The wallet according to claim 1, wherein the hinge further comprises a spring biased for rotating the first housing away from the second housing when the lock is disengaged.

5. The wallet according to claim 1, wherein the first and second housing covers are made from a material selected from the group consisting of aluminum, titanium, steel, copper, brass and carbon fiber-reinforced materials.

6. The wallet according to claim 1, wherein the first and second housing covers each have a minimum thickness of at least 0.020 inches.

7. The wallet according to claim 1, wherein at least one of the top portions of the first and second housing covers are integrally formed with the side walls on its respective housing cover and comprises a rounded exterior edge connecting the top portion and the side walls of the housing cover, the rounded exterior edges extending between the front and rear portions of the respective housing base, the rounded exterior edges having a minimum diameter of 0.040 inches.

8. The wallet according to claim 1, further including a drawer having a generally rectangular shape and adapted to be received within and withdrawn from at least one of the first and second card chambers, the drawer being adapted to store small articles.

9. The wallet according to claim 1, wherein at least one of the first and second trays further comprises a card holding means for holding at least one card.

10. The wallet according to claim 1, wherein at least one of the first and second trays further comprises an article holding means configured for holding paper currency and cards.

11. An ergonomic quick access wallet comprising:

a first and second housing;

the first housing comprising:

(a) a first housing base having a generally rectangular shape with two longitudinal sides and two transverse ends, the first housing base having a bottom portion, a rear portion, and a front portion, the bottom portion of the first housing base having an interior surface and an exterior surface;

the first housing base including a pair of guide walls proximate to and spaced from either longitudinal side of the first housing base;

at least one of the sides of the first housing base comprising flexible members, each flexible member having a protrusion extending outwardly;

each flexible member having a relief hole located behind each flexible member allowing each flexible member to flex backward;

(b) a first housing cover having a generally rectangular planar shape with two longitudinal sides and two transverse ends, the first housing cover further comprising a top portion and a pair of side walls upstanding from the two longitudinal sides of the first housing cover;

the side walls of the first housing cover including apertures receiving the protrusions of the first housing base to attach the first housing cover to the first housing base;

wherein the first housing cover is attached to the first housing base, the first housing cover substantially covering the interior surface and the two longitudinal sides of the first housing base, the side walls of the first housing cover extending between the front portion and the rear portion of the first housing base to form a first card chamber, the first card chamber being configured to receive at least one card, the interior surface of the bottom portion of the first housing base forming a surface of the first card chamber;

wherein the rear portion of the first housing base has a first card opening formed therein configured to allow cards to pass through the first card opening and into and out of the first card chamber;

wherein the front portion and the rear portion of the first housing base as well as the side walls of the first housing cover each extend past and substantially perpendicular to the bottom portion of the first housing base and, together with the exterior surface of the bottom portion of the first housing base form a first tray for receiving contents;

the second housing comprising:

(a) a second housing base having a generally rectangular shape with two longitudinal sides and two transverse ends, the second housing base having a bottom portion, a rear portion, and a front portion, the bottom portion of the second housing base having an interior surface and an exterior surface;

the second housing base including a pair of guide walls proximate to and spaced from either longitudinal side of the second housing base;

at least one of the sides of the second housing base comprising flexible members, each flexible member having a protrusion extending outwardly;

each flexible member having a relief hole located behind each flexible member allowing each flexible member to flex backward;

(b) a second housing cover having a generally rectangular planar shape with two longitudinal sides and two transverse ends, the second housing cover further comprising a top portion and a pair of side walls upstanding from the two longitudinal sides of the second housing cover;

the side walls of the second housing cover including apertures receiving the protrusions of the second housing base to attach the second housing cover to the second housing base;

wherein the second housing cover is attached to the second housing base, the second housing cover substantially covering the interior surface and the two longitudinal sides of the second housing base, the side walls of the second housing cover extending between the front portion and the rear portion of the second housing base to form a second card chamber, the second card chamber being configured to receive at least one card, the interior surface of the bottom portion of the second housing base forming a surface of the second card chamber;

wherein the rear portion of the second housing base has a second card opening formed therein configured to allow cards to pass through the second card opening and into and out of the second card chamber;

wherein the front portion and the rear portion of the second housing base as well as the side walls of the second housing cover each extend past and substantially perpendicular to the bottom portion of the second housing base and, together with the exterior surface of the bottom portion of the second housing base form a second tray for receiving contents;

a hinge joining the first and second housings, the housings being rotatable about the hinge between an open position and a closed position;

wherein in the closed position the front portion of the first housing comes into close proximity to the front portion of the second housing and the rear portion of the first housing comes into close proximity to the rear portion of the second housing and the ends of each pair of the side walls come into close proximity to each other and retain any contents stored in the first or second tray;

wherein while in the closed position the exterior surfaces of the bottom portions of the first and second housing bases face each other;

wherein at least one of the first and second trays include a clip for storing paper currency or cards between the clip and the exterior surface;

the ergonomic quick access wallet including a lock for securing the first housing closed against the second housing to keep the wallet in the closed position; and wherein the first and second housing covers are made from a substantially rigid RFID protective material.

12. The wallet according to claim 11, wherein at least one of the first and second card chambers comprises at least one resilient means for frictionally engaging cards within the respective card chamber, the resilient means being disposed in a gap in a guide wall.

13. The wallet according to claim 11, wherein at least one of the top portions of the first and second housing covers comprises a finger aperture formed therethrough for slidably ejecting cards through the card openings.

14. The wallet according to claim 11, wherein the hinge further comprises a spring biased for rotating the first housing away from the second housing when the lock is disengaged.

15. The wallet according to claim 11, wherein the first and second housing covers are made from a material selected from the group consisting of aluminum, titanium, steel, copper, brass and carbon fiber-reinforced materials.

16. The wallet according to claim 11, wherein the first and second housing covers each have a minimum thickness of at least 0.020 inches.

17. The wallet according to claim 11, wherein at least one of the top portions of the first and second housing covers are integrally formed with the side walls on its respective housing cover and comprises a rounded exterior edge connecting the top portion and the side walls of the housing cover, the rounded exterior edges extending between the front and rear portions of the respective housing base, the rounded exterior edges having a minimum diameter of 0.040 inches.

18. The wallet according to claim 11, further including a drawer having a generally rectangular shape and adapted to be received within and withdrawn from at least one of the first and second card chambers, the drawer being adapted to store small articles.

19. The wallet according to claim 11, wherein at least one of the first and second trays further comprises a card holding means for holding at least one card.

* * * * *